United States Patent [19]

Antrim et al.

[11] 3,985,477

[45] Oct. 12, 1976

[54] TUBE CORE APEX SEAL FOR ROTARY COMBUSTION ENGINE

[75] Inventors: Warren W. Antrim, Dayton; Gene P. Baynes, Kettering; Thomas C. Downs, Tipp City; James E. Enghauser, Kettering, all of Ohio

[73] Assignee: General Motors Corporation, Detroit, Mich.

[22] Filed: May 30, 1975

[21] Appl. No.: 582,232

[52] U.S. Cl. ..... 418/122; 418/152; 418/179; 29/420.5; 29/423

[51] Int. Cl.[2] ..... F01C 19/04; F01C 21/00; F04C 27/00

[58] Field of Search ..... 418/113–124, 418/266–268, 152, 179; 277/81 P, 235 R; 29/191, 191.6

[56] References Cited

UNITED STATES PATENTS

| | | | |
|---|---|---|---|
| 3,180,564 | 4/1965 | Fuhrmann et al. | 418/122 |
| 3,263,913 | 8/1966 | Fuhrmann et al. | 418/113 |
| 3,619,430 | 11/1971 | Hiratsuka et al. | 277/235 R |
| 3,869,259 | 3/1975 | Lindsey | 29/182.8 |
| 3,904,405 | 9/1975 | Russell et al. | 418/179 |

FOREIGN PATENTS OR APPLICATIONS

| | | | |
|---|---|---|---|
| 612,454 | 7/1926 | France | 418/152 |

*Primary Examiner*—John J. Vrablik
*Attorney, Agent, or Firm*—George A. Grove

[57] ABSTRACT

In a preferred embodiment an apex seal for a rotary combustion engine is disclosed having a hollow, thin wall, tubular, metal core member embedded in an extruded composite metal-carbon matrix. The seal is adapted to slidably engage the slot of the rotor in which it rides, and to sealingly engage the rotor housing against which it is spring and gas pressure biased. The incorporation of the hollow tubular core in the extruded seal permits a reduction in weight with no significant loss in flexural strength or wear resistance. It also provides gas pressure balance, end to end.

3 Claims, 12 Drawing Figures

TUBE CORE APEX SEAL FOR ROTARY COMBUSTION ENGINE

This invention relates to a readily fabricated, lightweight, stiff, wear resistant apex seal construction for use in rotary machines. More particularly, this invention relates to an apex seal formed by coextruding a composite metal-carbon, wear resistant body member around a lightweight, thin wall, tubular core member. The hollow core member permits a reduction in the weight of the seal while stiffening the compacted metal-carbon material in which it is disposed and to which it is metallurgically bonded.

Rotary mechanisms, such as internal combustion engines, pumps and compressors, are known and now being developed for many different applications. In general, such rotary mechanisms comprise an outer peripheral wall body, interconnecting a pair of parallel end walls to define a cavity whose peripheral shape is basically an epitrochoid. A rotatably mounted rotor is supported on a shaft within the cavity. The outer surface of the rotor defines a plurality of circumferentially spaced apex portions having radially movable seal strips mounted therein for sealing engagement with the inner surface of the peripheral wall. Thus, working chambers are formed between the rotor and peripheral wall which vary in volume upon relative rotation of the rotor and the outer body. An intake port is provided which, in the case of an internal combustion engine, admits air or an air-fuel mixture for supplying the combustion zone of the engine. An exhaust port is provided for expelling the working fluid, such as the burnt gases in the case of the engine. In an engine ignition means may be provided for ignition of the fuel-air mixture so that the stages of intake, compression, expansion and exhaust may be carried out.

In the successful operation of a rotary mechanism of the type described there must be effective sealing contact between the apex seal strips and the inner surface of the peripheral wall throughout the useful life of the mechanism. In fact, the efficiency of the mechanism depends in large measure upon there being minimal leakage between each seal and the peripheral surface so that the several working chambers are isolated from each other. Particularly in the case of the rotary engine, the construction and materials of the seal and the housing members must be considered together. The seal is advantageously light in weight so that the dynamic forces that it experiences and its wear rate and that of the peripheral wall are as low as possible. The seal must have high flexural strength because it is subject to greatly and rapidly varying pressures and temperatures. The material of construction of both the apex seal and the wear surface of the peripheral housing must be such that they are individually reasonably resistant to wear without unduly increasing the wear of the other. The subject invention provides an easily fabricated seal which is light enough to minimize chatter, score or wear of the peripheral housing, and sufficiently strong and wear resistant to survive the hostile environment in which it must operate.

It is an object of the present invention to provide an apex seal member having at least one longitudinally disposed, hollow, thin wall, metal tube core embedded in a body portion of suitable carbon particles distributed in a metallic matrix. The carbon particle - metal matrix composition of the body member provides wear resistant and low friction. The one or more hollow tubular core members permits a substantial reduction in weight of the seal while at the same time stiffening the carbon particle - metallic body portion. When the metallic phase of the seal body is a suitable aluminum-silicon alloy or titanium-bronze alloy, the seal member is particularly compatible in rotary engines having a chromium peripheral housing surface.

It is a further object of our invention to provide an apex seal construction containing a hollow, thin wall, metal tube core member, which seal can readily be formed by coextruding the tube with a mixture of finely divided particular carbon and suitable finely divided metal. The resultant seal is a lightweight, stiff, compacted body characterized by a longitudinally disposed, hollow, thin wall, metal tube embedded in a body consisting of a suitable metallic matrix containing $-44\mu$ carbon particles distributed therethrough. Preferably, the metallic tube core is metallurgically bonded to the metallic phase of the wear resistant body material.

In accordance with a preferred embodiment of our invention these and other objects are accomplished by forming the subject apex seal member by the following process. A generally cylindrical steel or copper thin wall can with one closed end is employed, one having a diameter of about 4½ inches and a height of about 10 inches. An aluminum, copper or titanium thin wall tube, ½ to 1 inch OD, is placed on end in the can at about the center of the closed end (or other suitable predetermined location within the can). There is considerable latitude in the cross-section of the tube. For example. it may be round, oval, square or the like of will be described. The initial cross-section of the tube, or course, can have a significant effect on the shape of the core tube in the extruded seal. The tube is filled with salt (or other suitable granular material) to prevent irregular collapse of the tube during an extrusion operation. A blended mixture of about equal proportions by weight of particulate carbon and powdered aluminum-silicon alloy (A-132) is tamped around the tube to fill the container. The container is evacuated to remove gases and sealed.

The sealed container is heated for about 1 hour at 800° to 1,100° F. and then extruded through a suitable extrusion die under a pressure of 800 to 1,200 tons per square inch. The container, powder mixture and metal tube are coextruded into a rod several feet in length. A reduction in area of the order of 50:1 to 75:1 is obtained during extrusion. The shape of the extrusion die orifice controls the cross-section of the extruded rod and significantly affects the final shape of the extruded tube therein.

After extrusion the original outer container material is removed from the rod either mechanically or chemically, and the salt is cleared from the tube. Apex seal blanks are cut to length and apex seals or apex seal portions are machined from the blanks, with the hollow tube remaining centrally located or otherwise as intended.

A resulting seal or seal member has a generally centrally located hollow metal tube or tubes disposed along the longitudinal axis. The tube is embedded in and preferably metallurgically bonded to a wear resistant body material consisting essentially of particulate carbon dispersed in and distributed throughout a metallic matrix. The metallic-particulate carbon body portion is wear resistant particularly when the seal is operating in sealing engagement with a hard chrome peripheral housing surface. Furthermore, the hollow metallic tube stiffens the wear resistant body material as it rapidly experiences varying pressures and temperatures in the operation of a rotary engine.

These and other objects and advantages of our invention will be more fully appreciated and understood from a detailed description thereof which follows. Reference will be made to the drawings, in which.

Figure 1:
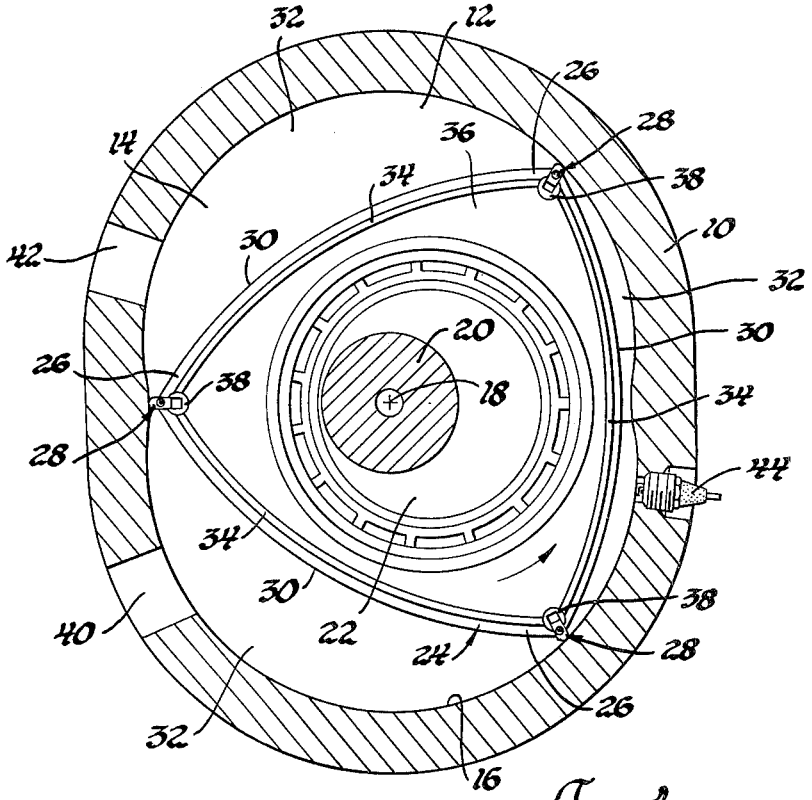
FIG. 1 is a view partly in section of the rotor housing and rotor assembly of a rotary engine containing apex seals of the subject invention.

With reference to FIG. 1, there is shown a view partly in section of the rotor assembly, including apex seals, and the peripheral housing of a rotary engine. In a common arrangement the rotary combustion engine comprises a peripheral wall or rotor housing 10. The rotor housing is interconnected with end housings 12 (only one shown) to form a rotor cavity 14. As viewed in FIG. 1, the inner surface 16 of the peripheral wall 10 has a multilobed (two-lobed) profile which is basically a two-lobed epitrochoid, or a curve parallel thereto, whose center is indicated at 18. A crankshaft 20 is rotatably supported within the end housing 12 by bearing means, not shown, so that the shaft axis is coincidental with a line through the center 18 parallel to the peripheral wall 16. The crankshaft 20 has an eccentric 22 in the rotor cavity 14. Rotatably supported on the eccentric 22 is a rotor 24 having three circumferentially spaced apex portions 26, in each of which there is a slot containing a spring-biased, radially slidable apex seal strip 28. Each seal strip 28 (see also FIGS. 2 through 6) extends completely across the rotor cavity 14 from one end housing 12 to the opposite one. As described herein the apex seal strips are one-piece seals. However, it is to be appreciated that it is well recognized in the art that each apex seal may be formed of two, three or more separate pieces which cooperate in the operation of the rotary mechanism to provide the sealing functions.

In the operation of the rotary engine depicted in FIG. 1, gearing (not shown in FIG. 1) is provided to enforce a fixed cyclic or phase relationship between the rotor 24 and the crankshaft 20 such that the crankshaft, which is the engine's output shaft, makes three complete revolutions for each complete revolution of the rotor. Such gearing typically comprises an annular, internally toothed gear received about and concentric with the crankshaft but rigidly secured to the engine housing, which gear meshes with an internally toothed gear concentric with and fixed to one side of the rotor.

The rotor faces 30 cooperate with the peripheral wall 16 and with side walls 12 to define three variable volume working chambers 32 that are spaced around and move with the rotor 24 within the housing 10 as the rotor orbits and rotates within the rotor cavity 14.

Side seals 34 are provided within each of the side faces 36 of the rotor 24 for sealing engagement with the inner surfaces of the end housings 12. These side seals 34 mate with corner seal bodies 38 in the grooves or slots in each of the apex portions 26 of the rotor 24. Thus, a continuous seal is provided for each of the working chambers 32 defined between the faces 30 and apex portions 26 of the rotor and inner surface 16 of the peripheral wall 10. As the rotor 24 and outer body 10 rotate relative to one another, the working chambers 32 being defined between the apex portions 26 of the rotor 24 and inner surface 16 of the peripheral wall 10 vary in volume, as is known.

As depicted in FIG. 1, an intake port 40 is provided in peripheral wall 10 for admitting air or a fuel-air mixture to combine the combustion zone of the engine. An exhaust port 42 is also provided in the peripheral wall 10 for expelling the combustion products. Ignition means 44 may be provided for ignition of the air-fuel mixture. It may be eliminated if the engine is run on a diesel cycle. In the operation of the engine the rotor 24 rotates in the direction indicated in FIG. 1.

Figure 2:
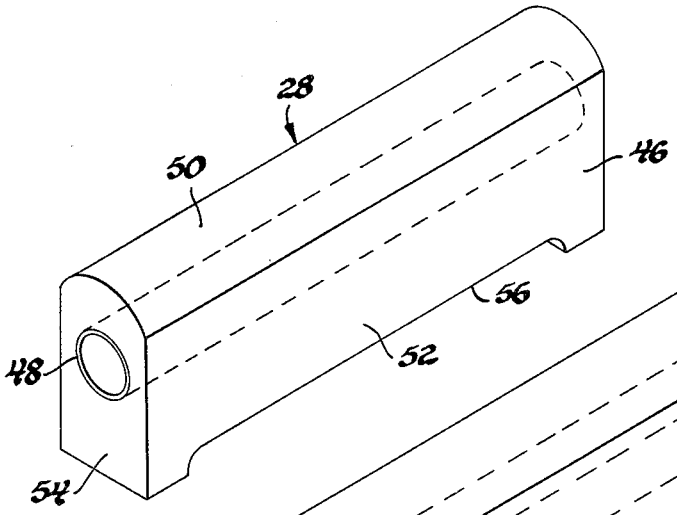
FIG. 2 depicts a rotary engine apex seal in accordance with our invention containing a single circular, thin wall tube core member.

Referring to FIG. 2, a one-piece type apex seal 28, like that depicted in the section of the rotary engine of FIG. 1, is shown. Apex seal 28 includes a body member 46 which contains embedded therein a hollow, thin wall, lightweight, metal tube core member 48. Core member 48 is disposed along the longitudinal axis of the seal member, as shown, and likewise generally centrally located within body member 46. A suitable material for core member 48 includes aluminum and aluminum alloys, copper and copper alloys, and titanium and titanium alloys. The body portion 46 of seal 28 is generally formed of an extruded, fully compacted mixture of particulate carbon and a suitable powdered metal alloy. Apex seal 28 has an arcuate upper surface 50 adapted to slidingly and sealingly engage the inner surface 16 of peripheral housing 10. The sides 52 of seal 28 are generally flat so as to slidingly engage the corresponding flat sides of the groove of the apex portion 26 of the rotor 24. In the embodiment shown the ends 54 of the seal 28 are likewise flat. The bottom of the seal contains a recessed portion 56 adapted to receive a suitable spring which serves to bias the seal against the inner surface 16 of the peripheral housing 10 in the operation of the engine.

The carbonaceous material employed in the body portion of the seal must initially be in finely divided particulate form, preferably −325 mesh size (−44 microns particle size), although somewhat larger particles (−200 +325 mesh) have been used. Pitting at the wear surface of the metal-carbon body portion is more likely to occur if the carbon mesh size is larger than −325 mesh. The carbonaceous particles employed in accordance with the invention are hard, wear resistant grades of carbon (amorphous or crystalline), such as anthracite coal, vitreous carbon and synthetic carbons containing crystalline carbon. Amorphous carbon-graphite mixtures (containing up to 15 to 20% graphite) may also be employed, but graphite alone is typically too soft for use as the carbon constituent in an apex seal. Calcined anthracite coal powder is preferred.

The metallic constituent of the body member is likewise initially provided in finely divided particulate form, preferably −325 mesh (−44 microns particle size). Aluminum and copper base alloys are preferred for use as the metallic constituent of the body member because they typically have adequate strength at operating temperatures together with wear resistance and low friction (in combination with the particulate carbon) and they are all formable at temperatures below about 1,800° F. In applications where less high temperature strength is permissible, other materials such as suitable alloys and mixtures of tin, lead, antimony, bismuth, magnesium and zinc may be used.

Examples of preferred alloys include aluminum casting alloys, such as aluminum alloy A-132 having a nominal composition by weight of 12% silicon, 2.5% nickel, 1.2% magnesium, 0.8% copper and the balance aluminum. An example of preferred copper-based alloys are titanium-bronze alloys consisting nominally by weight of 5% to 20% titanium, 3% to 33% lead, up to 15% tin and the balance copper. The above compositions are intended to be illustrative and a wide range of aluminum-silicon casting alloys as well as copper-based alloys are suitable.

Mixtures of carbon particles and metal powders are employed in the practice of this invention. The proportions depend upon the rotary machine application contemplated and the specific alloy employed. In general, it is desirable to employ about equal parts by volume of the particulate carbon and the metal powder. When a carbon-aluminum alloy-based seal for a rotary engine is to be formed, preferably about equal parts by weight of the carbon powder and aluminum base alloy powder are measured out and thoroughly blended using standard blending techniques and equipment. This powder mixture is then coextruded with a suitable tubular core member as will be described. When a carbon particle - copper base alloy seal body for a rotary engine is to be formed, preferably 80 parts by weight of a titanium-bronze alloy per 20 parts by weight of calcined anthracite are measured out and blended. The above proportions are illustrative and there can be variation in the respective amounts of metal particles and carbon particles.

Figure 7:
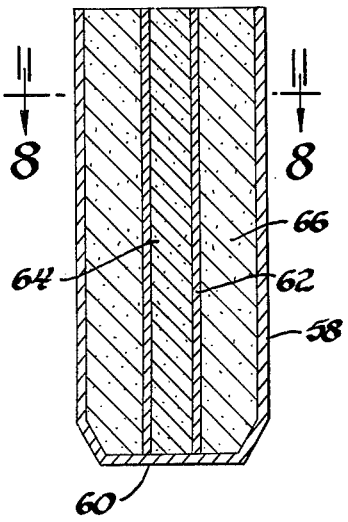
FIG. 7 is an elevational view, in section, of a metal can container and contents employed in a preferred method of forming apex seals in accordance with the invention.
Figure 8:
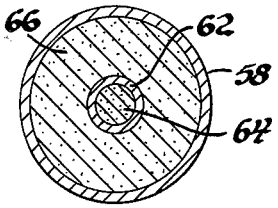
FIG. 8 is a cross-sectional view of the filled container of FIG. 7 taken at the plane indicated by line 8—8.

In accordance with a preferred practice of our invention, a tube core apex seal is made as follows. A thin wall can or container, such as depicted in section at 58 in FIGS. 7 and 8, is provided. The can is suitably formed of copper or low carbon steel. The can 58 is generally cylindrical in configuration and tapered adjacent the closed bottom end 60 to enter an extrusion die and facilitate the commencement of an extrusion operation (see FIG. 7). By way of example, a suitable container 58 has a wall 1/16 to ⅛ inch in thickness, an outside diameter of 4½ inches and a height of 6 inches.

Figure 9:
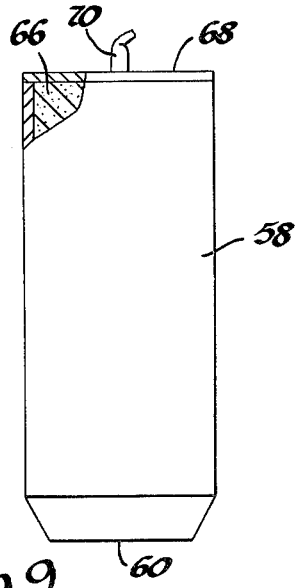
FIG. 9 is an elevational view of a sealed container preparatory to heating and extrusion.

A round tube 62 of aluminum, copper, titanium or other strong, lightweight metal is axially centered in the container 58 standing on one of its ends, as seen in FIG. 7. This tube eventually becomes the core tube of the finished apex seal. The tube may be filled with a quantity of granular, water soluble salt 64 to prevent irregular collapse during its extrusion. The tube 62 initially has a 1/16 to ⅛ inch wall thickness and is typically ½ to 1 inch in outside dimension. A mixture 66 of carbon and metal particles, as described above (e.g., equal parts by weight of −44$\mu$ particle size calcined anthracite powder and −44$\mu$ particle size A-132 aluminum alloy powder), is then placed in the container 58 outside of the tube 62. The powder mixture 66 is settled by vibration or compacting to fill the extrusion container 58. After the filling of the container 58 with powder 66, the container is provided with a cap 68 (see FIG. 9). Cap 68 suitably contains a small vent line 70 through which the container is evacuated to remove gases. The container is then sealed by crimping vent line 70 as shown in FIG. 9.

Figure 10:
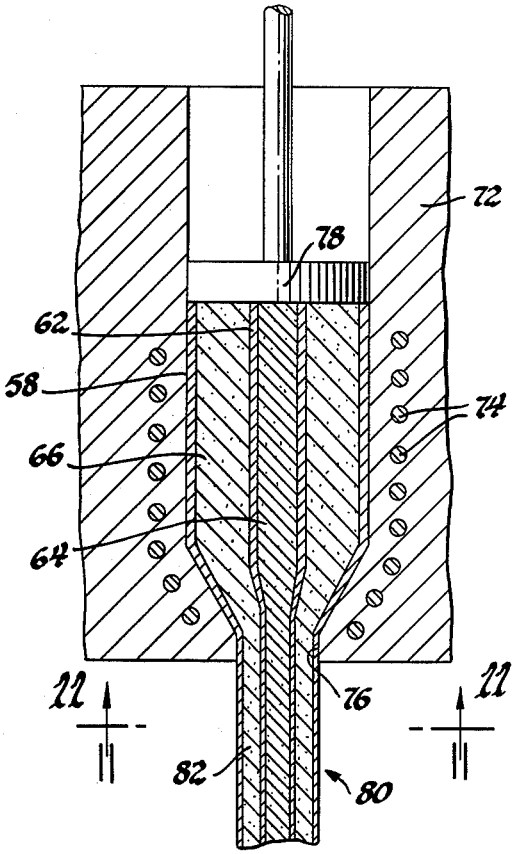
FIG. 10 is a sectional view of the container in a suitable extrusion apparatus during extrusion.
Figure 11:
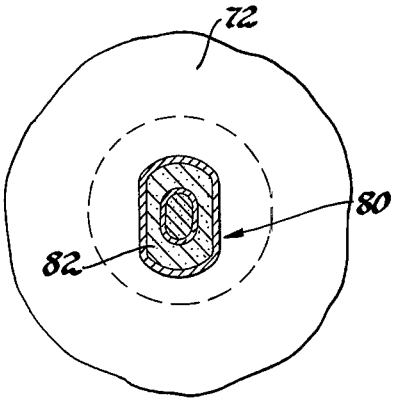
FIG. 11 is a cross-sectional view of the extruded composite rod, the sectional view being taken at the plane indicated by line 11—11 in FIG. 10.

The container and its contents are then heated to a suitable elevated temperature for extrusion, the specific temperature range depending upon the metallic constituent of the metal-carbon powder mixture. If the metallic constituent is an aluminum base alloy, the container and contents are preferably through-heated for 30 to 60 minutes at a temperature in the range of 800° to 1,100° F. If a copper base alloy is employed in the carbon-metal mixture, the container and its contents should be heated throughout at a temperature from about 1,500° to 1,700° F. for 30 to 60 minutes. The preheated container is then placed in a suitable extrusion chamber 72 (see FIG. 10). The extrusion chamber 72 may contain heating elements 74. At the outlet of the extrusion device is an extrusion die orifice 76 through which the preheated container and its contents are forced. Ram pressure, indicated at 78, of 800 to 1,200 tons per square inch is exerted on the container and the container, metal-powder mixture and metal tube are coextruded through the extrusion die into a rod 80 up to 12 feet or longer in length. Typically, enough internal pressure is created at the die orifice 76 to cause the bottom of the container to burst at the extrusion die and all the materials therein to flow through the die. The shape of the extrusion die orifice controls the cross-section of the extruded rod 80 (see FIG. 11) and also the general shape of the tube 62 in the extruded rod 80. For example, an oval shaped die will yield an oval shaped tube, as shown in FIG. 11; a square die will yield a square tube, etc.

During the extrusion a 50 to 75 fold reduction in area is obtained. For example, from the above-described extrudable package an oval shaped rod having cross-sectional dimensions of ⅝ × ⅜ inch and containing an oval core tube (3/16 × 3/32 inch) may be produced. The container 58 and tube 62 wall thicknesses are both greatly reduced to about 0.020 to 0.040 inch. FIGS. 7, 8 and 10 depict only approximately the thickness of the container 58 and tube 62 prior to extrusion. The illustrated thicknesses of these items after extrusion are somewhat exaggerated to more clearly show their position and configuration.

The heat produced by the working of the preheated metal particles sinters them into a continuous metallic matrix through which is distributed the finely divided carbon particles. (For example, see FIG. 12.) In other words, in accordance with our invention the wear resistant body portion (indicated at 82 in FIGS. 10 and 11) of the seal is formed of a metallic matrix containing many particles of carbon. The proportions of metal and carbon are preferably such that if a body portion is sectioned and examined microscopically the total area of the carbon particles viewed is about equal to the area of metallic matrix. In the situation when an aluminum-silicon base alloy is formed, aluminum carbide may be formed at the interface of the aluminum base alloy and the carbon particles and a metallurgical bond formed between the aluminum base alloy and the metal tube core. Similarly, when a titanium-containing copper base alloy is employed, titanium carbide may be formed at the interface of the copper alloy phase and the carbon particles distributed therein. A metallurgical bond is also formed between the copper base alloy and the metal tube core member.

Figure 12:
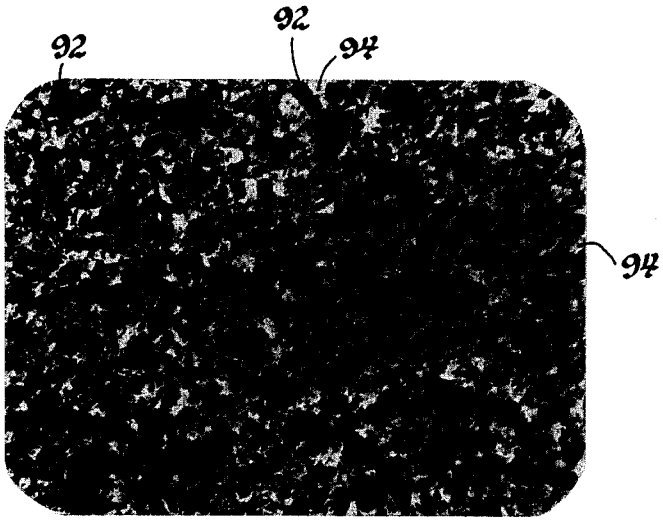
FIG. 12 is a photomicrograph at 200× magnification showing the microstructure of a portion of a body member of a subject apex seal.

FIG. 12 is a photomicrograph (at 200×) illustrating the microstructure of a titanium bronze-carbon body portion. The microstructure consists of carbon particles 92, each surrounded by the copper alloy metallic phase 94. Preferably, there is a metallurgical bond between the metallic phase and the carbon. Titanium from the metallic phase reacts with the carbon to form titanium carbide at the carbon-metal interface. The presence of the titanium carbide bond at the interface is detectable by X-ray diffraction and an electron microprobe analysis for titanium.

Figure 3:
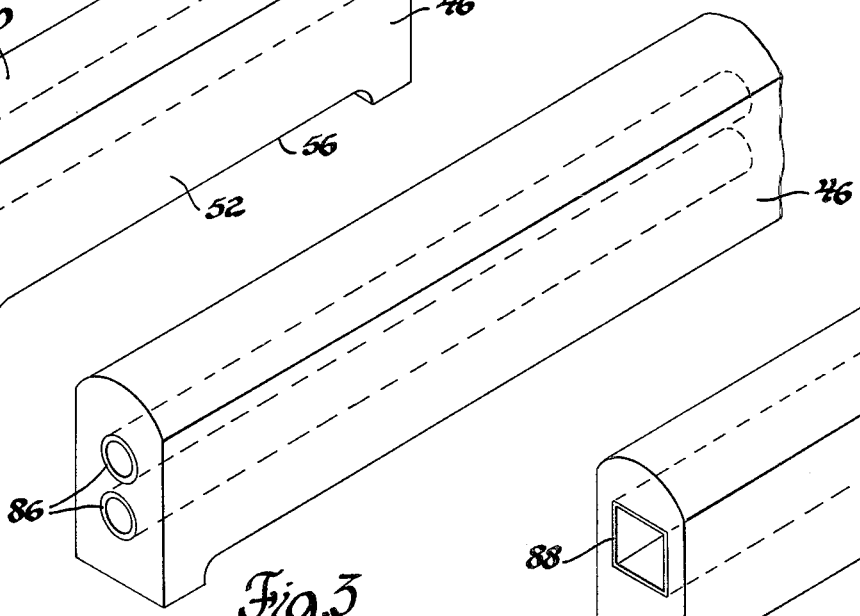
FIG. 3 depicts another embodiment of the invention in which a single-piece apex seal is constructed having two relatively small, hollow, thin wall, circular metallic core members.
Figure 4:
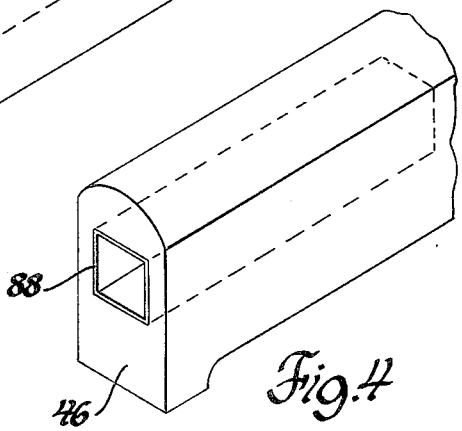
FIG. 4 depicts another embodiment of the invention in which an apex seal is formed having a generally square, thin wall, metallic, tubular core member.
Figure 5:
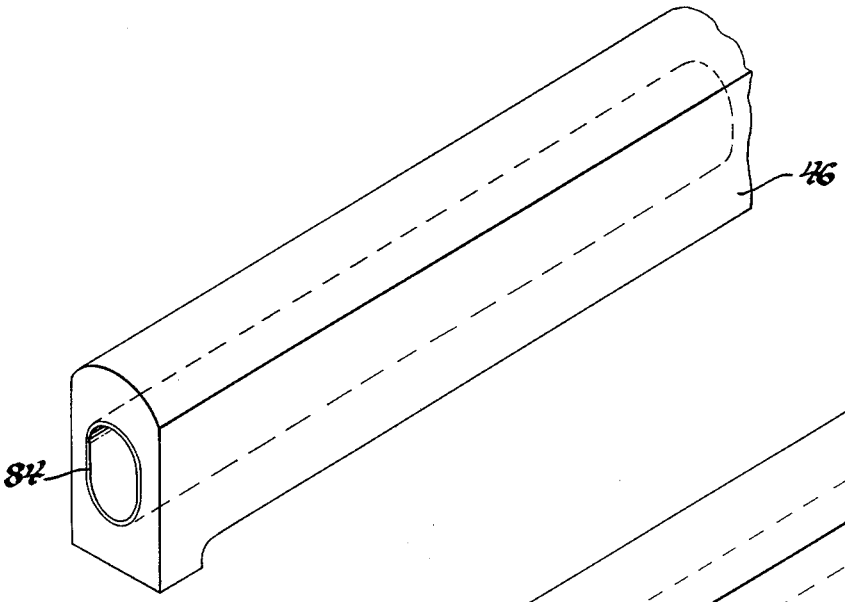
FIG. 5 depicts a further embodiment of the invention, an apex seal having a generally oval, thin wall, metallic, tubular core member.
Figure 6:
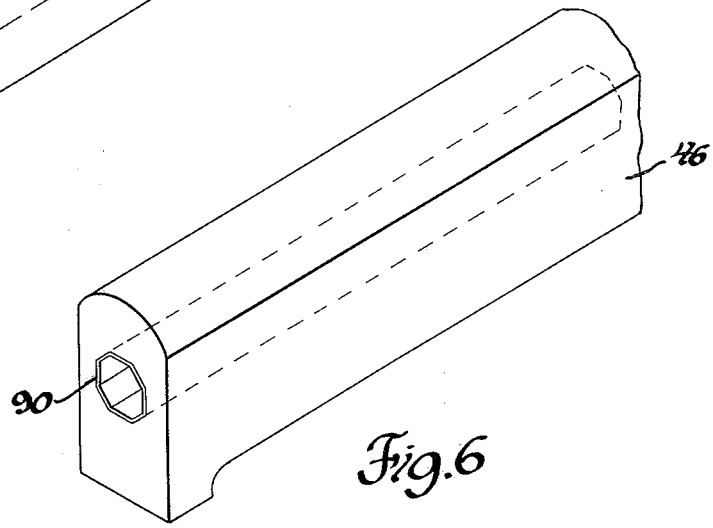
FIG. 6 depicts still another embodiment of the invention, an apex seal having an octagonal, thin wall, metallic tubular core member.

After extrusion the outer container material is removed from the extruded rod. This can be accomplished by pickling or by machining. Salt is removed from the inside of the extruded tube core member by dissolution or vibration. Apex seal blanks are cut to length from the extruded rod. Apex seals, such as that depicted in FIG. 5, are then machined from the extruded rod. In FIG. 5 the tubular core member 84 is oval in cross-section. It is longitudinally disposed in body member 46. Depending upon the number of tubes and their initial shape and the shape of the extrusion die, tube core apex seals may be formed with variations as displayed in FIGS. 2, 3, 4, 5 and 6. In FIG. 3 two small, circular, metal tube cores 86 are longitudinally disposed in body member 46. In FIG. 4 a square tube core 88 is shown longitudinally disposed and embedded in body member 46. In FIG. 6 a tube core 90 having a cross-section of a regular octagon is depicted. In all cases the body portion 46 of the seal is made up of a wear resistant material which is a metallic matrix containing distributed therein finely divided carbon particles. Preferably, the metallic portion of the wear resistant body member 46 of the seal is metallurgically bonded in the extrusion process to the tube core member. The tube core member is approximately centrally located in the seal so that there is ample wear resistant body member material surrounding it so that there can be considerable wearing of the seal before the tubular core is exposed. Specifically, (referring to FIG. 2) the core tube 48 lies parallel to and a minimum distance of 0.080 inch from the arcuate upper surface 50 adapted to slide in sealing engagement against the rotor housing.

Thus the apex seal members of our invention are lightweight, stiff, strong, wear resistant and provide low friction. The wear resistance and low friction is provided principally by the metal-carbon composite body portion, as described above. Reduced weight results both from the nature of the materials employed and the structure of the seal which contains one or more hollow bores produced by embedding a lightweight, thin wall, metal tube in the wear resistant body material. The core tube enhances the utility of the apex seal by stiffening it and thereby increasing its resistance to flexing during the rapidly changing pressure and temperature conditions experienced by the seal in the operation of an engine. Moreover, while offering all of the above advantages, the seal is also readily formed by a coextrusion process.

While our invention has been described in terms of certain specific embodiments thereof, it will be appreciated that other forms could readily be adapted by one skilled in the art. Therefore, the scope of our invention is to be considered limited only by the following claims.

What is claimed is:

1. In a rotary combustion engine comprising a rotor housing defining an inner peripheral surface in the shape of an epitrochoid, said rotor housing interconnecting two parallel end walls, the rotor housing and end walls defining a rotor cavity, a rotor rotatably mounted in said rotor cavity, said rotor having circumferentially spaced apex portions each including a slot aligned parallel to the rotational axis of said rotor and containing a spring-biased apex seal adapted to engage said peripheral surface in sliding, sealing contact, the improvement wherein said apex seal comprises:

a hollow, tubular, metal core member embedded in a wear resistant body member consisting essentially of carbon particles uniformly distributed through a metal matrix, the core member being disposed longitudinally in said seal, said hollow core member providing a reduction in weight of said seal without reducing the flexural strength or wear resistance as compared to an apex seal of the same external size and shape but formed fully of said body member material.

2. In a rotary combustion engine comprising a rotor housing defining an inner peripheral surface in the shape of an epitrochoid, said rotor housing interconnecting two parallel end walls, the rotor housing and end walls defining a rotor cavity, a rotor rotatably mounted in said rotor cavity, said rotor having circumferentially spaced apex portions each including a slot aligned parallel to the rotational axis of said rotor and containing a spring-biased apex seal adapted to engage said peripheral surface in sliding, sealing contact, the improvement wherein said apex seal comprises:

a hollow, thin wall, tubular, lightweight, metal core member embedded in a wear resistant body member consisting essentially of carbon particles initially smaller than 44 microns in particle size uniformly distributed through a metal matrix, there being a metal carbide metallurgical bond at the interface of said matrix and said carbon particles, the core member being disposed longitudinally in said seal.

3. In a rotary combustion engine comprising a rotor housing defining an inner peripheral surface in the shape of an epitrochoid, said rotor housing interconnecting two parallel end walls, the rotor housing and end walls defining a rotor cavity, a rotor rotatably mounted in said rotor cavity, said rotor having circumferentially spaced apex portions each including a slot aligned parallel to the rotational axis of said rotor and containing a spring-biased apex seal adapted to engage said peripheral surface in sliding, sealing contact, the improvement wherein said apex seal comprises:

a hollow, thin wall, tubular, lightweight, metal core embedded in an extruded wear resistant body member consisting essentially of calcined anthracite coal particles initially less than 44 microns in average size uniformly distributed in a metal matrix, the metal of said matrix being selected from the group consisting of aluminum-based alloys and copper-based alloys, said core being disposed longitudinally in said seal and formed of a metal taken from the group consisting of aluminum, aluminum-based alloys, copper, copper-based alloys, titanium and titanium-based alloys.

* * * * *